US010273036B2

(12) United States Patent
Morris, Jr.

(10) Patent No.: US 10,273,036 B2
(45) Date of Patent: Apr. 30, 2019

(54) OPEN END CONTAINER WITH IMPROVED SEAL

(71) Applicant: Glenn H. Morris, Jr., Chattanooga, TN (US)

(72) Inventor: Glenn H. Morris, Jr., Chattanooga, TN (US)

( * ) Notice: Subject to any disclaimer, the term of this patent is extended or adjusted under 35 U.S.C. 154(b) by 98 days.

(21) Appl. No.: 15/446,142

(22) Filed: Mar. 1, 2017

(65) Prior Publication Data

US 2017/0291744 A1 Oct. 12, 2017

Related U.S. Application Data

(60) Provisional application No. 62/318,968, filed on Apr. 6, 2016.

(51) Int. Cl.
*B65D 1/12* (2006.01)
*B65D 43/02* (2006.01)

(52) U.S. Cl.
CPC ..... *B65D 1/12* (2013.01); *B65D 43/0277* (2013.01); *B65D 2543/00092* (2013.01); *B65D 2543/00296* (2013.01); *B65D 2543/00481* (2013.01); *B65D 2543/00537* (2013.01); *B65D 2543/00555* (2013.01); *B65D 2543/00972* (2013.01)

(58) Field of Classification Search
CPC ..... B65D 53/02; B65D 1/12; B65D 43/0231; B65D 2543/0099; B65D 2543/00537; B65D 2543/00564
USPC ..... 220/304
See application file for complete search history.

(56) References Cited

U.S. PATENT DOCUMENTS

| | | | | |
|---|---|---|---|---|
| 2,209,081 | A * | 7/1940 | Rocic | B65D 43/0229 220/214 |
| 4,027,777 | A * | 6/1977 | Blanke, Jr. | B65D 43/0231 215/DIG. 1 |
| 4,177,934 | A * | 12/1979 | Hammes | B29C 49/4802 215/275 |
| 5,101,993 | A * | 4/1992 | Nairn | B65D 53/00 215/232 |
| 6,170,691 | B1 * | 1/2001 | Morris, Sr. | B65D 21/0219 206/508 |
| 6,318,577 | B1 * | 11/2001 | Suttoni | B65D 43/0231 215/329 |
| 6,708,839 | B2 * | 3/2004 | Diesterbeck | B65D 1/46 206/508 |
| 2002/0096522 | A1 * | 7/2002 | Palvoelgyi | B60K 15/03 220/378 |

* cited by examiner

*Primary Examiner* — James N Smalley
(74) *Attorney, Agent, or Firm* — Stephen J. Stark; Miller & Martin PLLC

(57) ABSTRACT

The open ended container with resealable lid combination has a seal ring which cooperates with a seal engagement surface to provide a resealable construction to provide at least one of an airtight and watertight configuration after the lid has initially been removed from the container and re-applied. The seal engagement surface preferably provides at least two ramps and the seal ring deforms along at least one, if not both of the ramps.

18 Claims, 3 Drawing Sheets

OPEN END CONTAINER WITH IMPROVED SEAL

CLAIM OF PRIORITY

This application claims the benefit of U.S. Provisional Application No. 62/318,968 filed Apr. 6, 2016, which is incorporated herein by reference in its entirety.

FIELD OF THE INVENTION

This application is directed to a open end container with an improved seal assembly.

BACKGROUND OF THE INVENTION

For years the applicant has been requested to provide a five gallon and possibly other sized pail with a lid that can reseal itself. Some applications could be directed to keeping paint fresh or other applications such as, but not limited to, those in which part of the contents were utilized but not all at once so that the remainder of the contents could be kept fresh for later use.

Additionally, a number of years ago, the applicant obtained U.S. Pat. No. 6,170,691 which has a seal located on an interior wall of the container. That technology is still in use today for particularly robust applications. However, new technology is believed to be useful for still further applications.

SUMMARY OF THE INVENTION

Accordingly, it is an object of many embodiments of the invention to provide an improved lid and container assembly.

The lid could be configured to be initially applied by a manufacturer to seal contents therein such as paint, chemicals or other components therein whereby the ingredients are ready for shipment. A tear-off strip with an internally directed hook (which can protect the seal) could be provided below internally directed threads of outer inwardly directed wall of the lid such as is described in co-pending application Ser. No. 14/956,441 filed Dec. 2, 2015, which is incorporated herein by reference in its entirety. Similarly, U.S. Pat. No. 6,170,691 is incorporated herein by reference in its entirety Typically manufacturers, if they utilize seals, use a material which does not deform significantly under pressure. These seals are placed against smooth surfaces whether they be substantially flat surfaces like the one shown in U.S. patent application Ser. No. 14/956,441 or like the concave surface shown in U.S. Pat. No. 6,170,691.

However, the applicant's new design is believed to provide a pail having an improved open end construction providing what is believed to be a unique construction which preferably cooperates with at least one set of threads on a lid. The lid may be screwed on and off and in this process, resealed relative to the contents internal to the container with a seal. The seal has increased surface area to act against based on a series of steps, ridges, or teeth, which can engage a somewhat resilient seal member so as to increase the surface area over which a seal can be formed. Additionally the steps, ridges, or teeth are laterally or even upwardly oriented since the pail, when formed by injection molding is typically ejected from the mold in the direction of top to bottom (i.e., the bottom leads the pail out of the mold).

Still other embodiments may have a seal member disposed above and/or at an upper rim of the pail in a channel of the lid to provide a seal possibly together with, or instead of, the seal member described above. Some embodiments of the present invention may also have one or more grips formed into the lid for use in opening and/or closing the lid relative to the pail.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENTS

Figure 1:
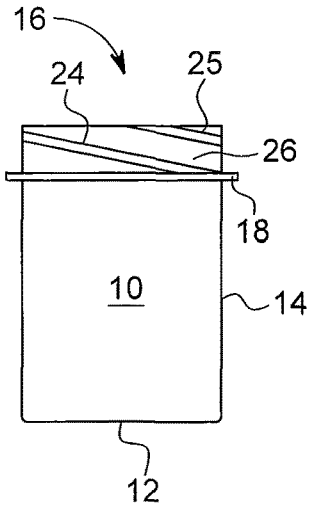
FIG. 1 shows an external plan view of a container of a presently preferred embodiment of the present invention.
Figure 2:
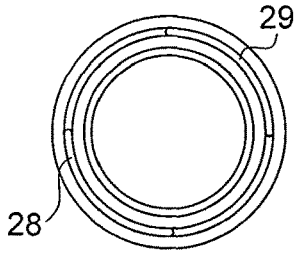
FIG. 2 shows a bottom plan view of a lid for use with the container of FIG. 1.

FIG. 1 shows a container 10 for use with a lid 22 as shown in FIG. 2. The container 10 may have threads or channels 24, 25 which cooperate with corresponding threads or channels 28, 29 in lid 22. Other embodiments may provide push on lids 22 which are downwardly directed onto container 10 as would be understood by those of ordinary skill in the art and do not need to "screw" on. Many embodiments will have a screw on lid 22 as illustrated. Other screw on lids 22 may have fewer or more threads 28, 29 or channels as would container 10.

As shown in FIGS. 1 and 2, the threads or channels 24, 25, 28, 29 may have multiple starting points so that one need only turn the lid 22 relative to the container 10 a certain amount to begin having threads/channels 28, 29, 24, 25 of the lid 22 and the container 10 engage. Other embodiments may or may not have interrupted threads/channels 24, 25, 28, 29 as are known in the art as well.

Container 10 has bottom 12 with upwardly extending side walls 14 defining a somewhat cylindrical shape with a substantially round perimeter for many embodiments as would be understood from the description and figures. At the upper end 16 of the container 10 is an opening leading into an internal volume 17 of the container 10. Satellite ring 18 may extend circumferentially and cantileveredly away from wall 14 and/or may also provide a hook for engaging a tear strip such as is describe in co-pending U.S. application Ser. No. 14/956,441, incorporated herein by reference in its entirety.

In some situations, it may be desirable for a lid 22 and container 10 to reseal after initial opening, such as if all the contents are not utilized. Paint and drywall dry out or degrade once the lid is initially removed from the pail. An improved design is believed to be desirable for such an embodiment and other embodiments.

Figure 3:
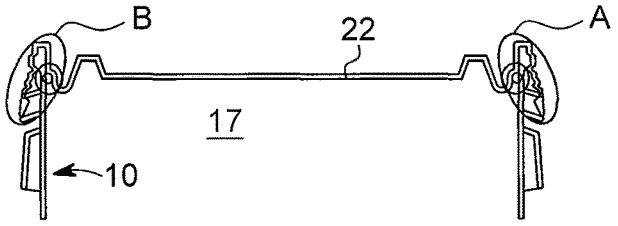
FIG. 3 shows a cross sectional view of the container showed in FIG. 1 together with a cooperating portion of a lid shown in FIG. 2 connected thereto.
Figure 4:
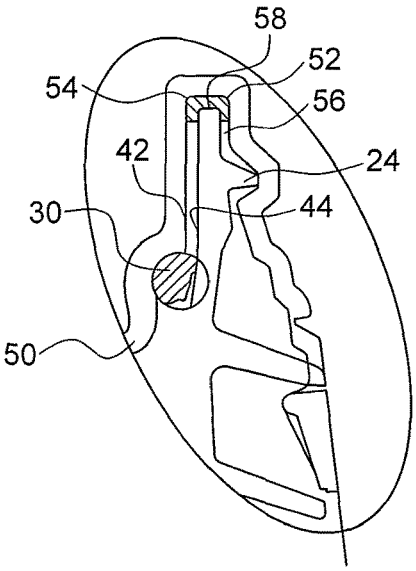
FIG. 4 shows a detailed portion of the connection of the lid to the container as shown in FIG. 3.
Figure 5:
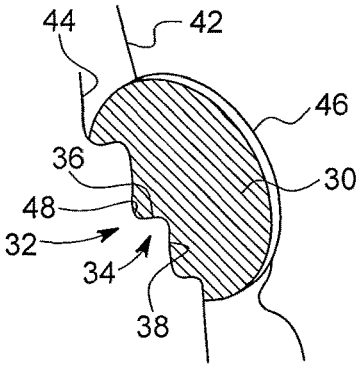
FIG. 5 shows a detailed portion of a compressed seal shown as detail B in FIG. 3.

To that effect, FIGS. 3 and 4 shows a portion of the container 10 having an internal seal ring 30. The container 10 has what is believed to be a new seal engagement surface 32 on the container 10 which is quite different than prior art designs.

Specifically, the engagement surface 32 preferably has at least two, if not three or more ramps, ledges or teeth 34 which each preferably provide angled surfaces 36, 38 which meet at a point or curve 40 that when a resilient first seal ring 30 is compressed against the seal engagement surface 32, the first seal ring 30 is compressed so as to contact portions of both angled surfaces 36, 38 on at least two of the teeth 34.

The angled surfaces may include a substantially vertically extending surface 38 and a substantially horizontally extending surface 36. For other embodiments, the surface 36 may be more vertically oriented, but as it relates to vertical axis 42, vertically extending surface preferably does not extend at an angle between 0 and 90 degrees (although it could extend vertically as shown, or anywhere between 270 and 360 degrees (or 90 to 180, depending on how it is viewed). There are a lot of different angular relationships that could be provided such as the almost 90 degree relationship between the surfaces 36, 38 illustrated. Other embodiments may provide an acute angle between the surfaces 36, 38, while other embodiments may provide an obtuse angle between the surfaces 36, 38. Furthermore, either of surfaces 36, 38 need not be planar for all embodiments as illustrated. For many embodiments, it is envisioned that the pail 10 will be directed away from a mold (which fills the cavity 17, preferably without slides) so that as the pail 10 is ejected, there are no undercuts into an interior wall surface 44, including the surfaces 36, 38 of the teeth 34 of the engagement surface.

On the lid 22, a channel 46 may assist in receiving the first seal ring 30 which may be resiliently retained therein, or adhered, so that it could be mechanically and/or chemically retained in positioned.

When securing the lid 22 relative to the container, the first seal ring 30 preferably compresses and deforms at the teeth 34 so that the first seal ring 30 contacts the curve 40 (or point), as well as at least a portion of the surfaces 36, 38 of at least two teeth 34. In fact, for some embodiments, at least one quarter, one third, if not half of at least one of the surfaces 36, 38 is contacted by the first seal ring 30 in-a closed configuration. Other embodiments may have at least one quarter, one third, if not half of both of the surfaces 36, 38 is contacted by the seal ring 30 in a closed configuration. Still other embodiments may have the first seal ring 30 contact an intersection 48 of adjacent teeth 34 in a closed configuration, depending on the softness, or resiliency of the first seal ring 30 selected. For many embodiments, it is envisioned that a closed cell neoprene gasket is selected for a seal ring 30 which is particularly soft or resilient.

For many embodiments, the first seal ring 30 contacts 46 of the lid 22 where it may be retained by a friction fit and/or adhesives. When placing the lid 22 on the container 10, the first seal ring 30 contacts the teeth 34 of the contact surface 32 to form, in many embodiments an airtight and/or water-tight seal of the lid 22 relative to the container 10 with the first seal ring 30.

The lid 22 may screw onto the container 10 and or be press fit, depending on the embodiment selected.

There are many different ways that the lid 22 can connect to a container 10. Press fitting (like pails containing paint or joint compound are often provided), or screw tops (like the one shown) are options. The first seal ring 30 is shown connected to an inner surface 42 of the lid 10 and the seal engagement surface 32 on the inner surface of the container 10. Other embodiments could provide the first seal ring 30 and/or the contact engagement surface 32 on other surfaces of the lid 22 and/or container 10.

The first seal ring 30 is shown below the threads 24 and/or 25 for many embodiments. Other embodiments may be constructed differently. The first seal ring 30 is also shown positioned above a lowest portion 50 of the lid 22 when installed for many embodiments.

FIG. 4 also shows a second seal ring 52 contacting rim 54 of the pail or container 10. Some embodiments may just use the second seal ring 52 instead of a first seal ring 30, and still others may not use a second seal ring 52 at all. The second seal ring 52 may be made of similar or dissimilar material as the first seal ring 30. When the lid 22 is secured to the container 10, such as by being screwed into place, the rim 54 may deform and/or seal against the second seal ring 52 to provide a fluid tight connection (such as liquid and/or air tight connection). Neither of the seal rings 30 or 52 are required to have a round cross section, but may shaped with various cross sections.

Second seal ring 52 may partially deform about inside surface 44 and/or the outside surface 56 at the rim 54 of the container 10, such as illustrated, or possibly just contact upper surface 58 of the rim 54. For some embodiments, the second seal ring 52 is sufficient to provide a fluid tight seal of the lid 22 to the container 10 in the closed configuration, such as illustrated in FIG. 4.

Figure 6:
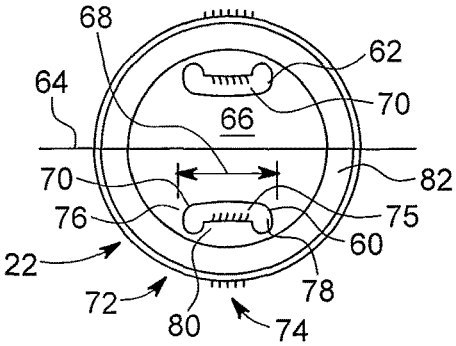
FIG. 6 shows a top plan view of a lid of a presently preferred embodiment of the present invention.
Figure 7:
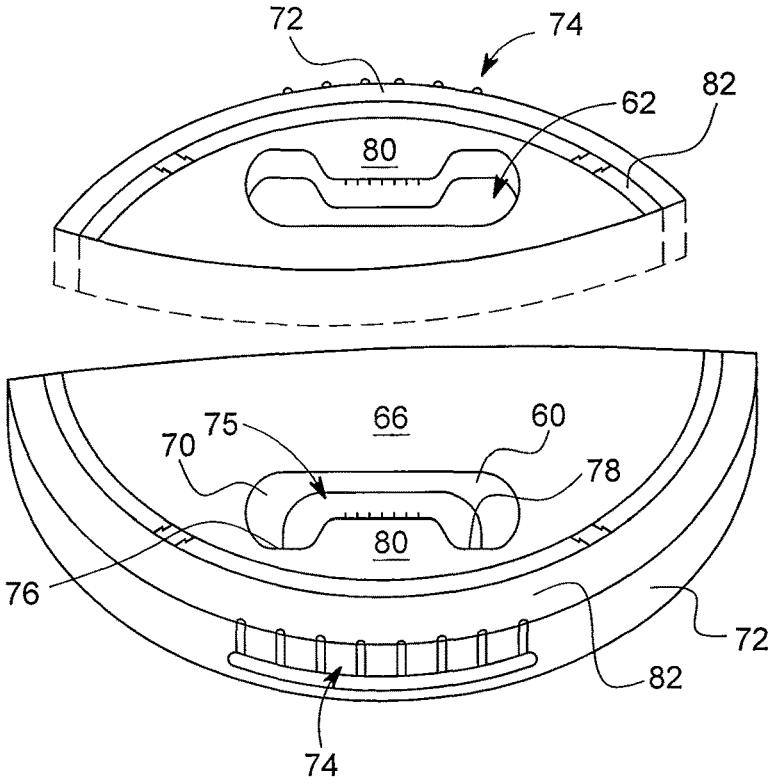
FIG. 7 shows a top perspective view of the lid of FIG. 6.

FIG. 6 shows another improvement for some embodiments of a lid 22. The lid 22 has formed first and second grips 60, 62 which are illustrated as symmetrically disposed about a centerline 64, but could be differently oriented for other embodiments. FIG. 7 shows the grips 60, 62 in a perspective view, which is also helpful to understand the construction.

Specifically, the grips 60, 62 may extend below an upper surface 66 of the lid 22 with a width 68 sufficient for the fingers of a user to extend into a cavity 70 with a palm contacting outer edge 72 of the lid 22 so as to securely grip the lid 22 in a gripping manner. Other embodiments may have the grips extending above an upper surface 66 of the lid 22. On the outer edge 72, radially extending outwardly directed ridges 74 can assist in a palm of a user maintaining a connection on the outer edge 72 for at least some embodiments.

Grips 60, 62 are preferably integrally formed into the lid 22. They are radially spaced from the centerline 64 proximate to the outer edge 72 of the lid 22 whereby a user can place the palm of a hand at the outer edge 72 and fingers into the cavity 70, if present.

Internal to the cavity 70 can be internally directed ridges 75, which may be parallel oriented toward the centerline 64, radially oriented and/or otherwise provided to assist in providing a connection with the fingers of a user. For some embodiments they may be angled acutely relative to the centerline 64, but probably not perpendicular thereto. A range of 0 (as shown) to about 60 degrees is preferable for at least some embodiments. The internally directed ridges 75 may be substantially coplanar with the externally directed ridges 74, and may extend an elevation below the outwardly directed ridges 74 on the outer edge 74 of the lid 22 for at least some embodiments. Shoulder 80 and/or groove 82 may separate the grips 60, 62 from the outer edge 72. Shoulder 80 may be parallel with upper surface 66 for at least some embodiments, or be elevated relative thereto as illustrated in FIG. 7.

While the grips 60, 62 may have generally elongated channels or cavities 70, they may also have radially outwardly oriented concave shoulders 76, 78 to assist in a portion of a user's fingers being able to push or pull the lid 22 tight when twisting shut as well as when opening, particularly depending on which hand the user selects to operate the lid 22 relative to the container 10. The grips 60, 62 can provide a significant mechanical advantage to the user for at least some embodiments. More than two, or fewer, concave shoulders 76, 78 could be provided with other embodiments.

With a palm of a user on the outer edge 72 and the fingers along the internally directed ridges 75, in the cavity 70 and/or along the shoulders illustrated as concave shoulders 76, 78, a grip believed to be unique to the container industry can be provided particularly for lids 22 which twist on and off containers 10. The shoulder 80 and/or groove 82 can provide sufficient spacing to make the hold a comfortable and useful hold for a user to then be able to twist the lid 22 relative to the container 10 as would be understood by those of ordinary skill in the art.

Figure 8:
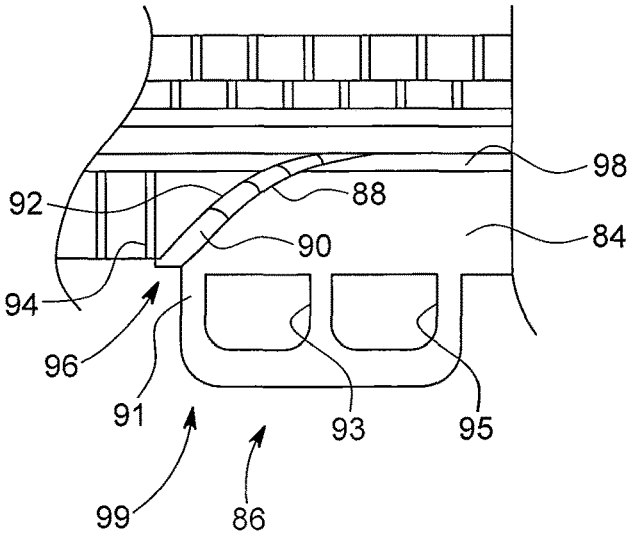
FIG. 8 shows a side plan view of a portion of lid shown in FIGS. 6 and 7.

These, or still other embodiments, may have a tear off strip 84 such as the one shown in FIG. 8 which may be similarly or dissimilarly constructed on the inside as provided in co-pending U.S. patent application Ser. No. 14/956,441. The strip 84 can have a double loop tear grip 86 which is believed to be novel for providing a more comfortable hold when removing the strip 84. The double loop construction for the tear grip 86 provides 50% more connection to the tear strip (three connections 91, 93, 95 instead of two) over a single loop tear grip so it can be stronger, while also receiving two fingers (one in each hole) instead of a single finger in a single hole. Additionally, a first end 88 of the strip 84 is initially spaced by gap 90 from a second end 92 of the strip 84. Spars 94, such as spaced apart spars 94 can span the gap 90 at locations which can readily break when removing the strip 84. The gap 90 can extend from a bottom edge 96 to a channel 98 where the tear strip 84 pulls away from the lid 22 when removed. The gap 90 preferably terminates within the channel 98, for at least some embodiments. The gap 90 may also narrow in width 99 from the bottom edge 96 to a termination point 97, such as within the channel 98, either continuously as illustrated and/or abruptly. The channel 98 preferably has a narrower thickness than surrounding material to facilitate a location for the tear strip to make the tear when pulling.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An open ended container with resealable lid combination comprising:

a container having a bottom with upwardly extending sides extending upwardly until terminating at a rim and an opening at an upper end of the sides providing access into an internal volume of the container, said container further having a seal engagement surface comprising at least two internally directed ramps, said ramps located along the sides below the rim and directed toward the internal volume of the container each comprised of first and second surfaces angled relative to one another;

a lid having a first seal ring secured to and circumnavigating the lid, internally disposed and spaced apart from an outer perimeter of the lid, wherein said lid has an open configuration whereby the lid is displaced relative to the opening thereby permitting access into the internal volume of the container, and a closed configuration whereby the lid prevents access into the internal volume of the container; and after removing the lid from the container, the lid has a reseal configuration whereby the lid with the first seal ring secured thereto is reattached to the container and the first seal ring resiliently deforms against portions of the first and second surfaces of the first and second ramps to provide at least one of an airtight and watertight connection and the first seal ring in communication with the internal volume of the container about an annular surface of the first seal ring.

2. The open ended container with resealable lid combination of claim 1 further comprising a satellite ring circumferentially disposed about an outer surface of the sides of the container, said satellite ring located below the seal engagement surface.

3. The open ended container with resealable lid combination of claim 1 wherein the lid further comprises a second seal ring, said second seal ring contacts the rim in the reseal configuration and is located above the first seal ring, and the container has externally directed threads on an exterior surface of the container, which cooperate with internally directed threads on the lid which separate to provide the reseal configuration.

4. The open ended container with resealable lid combination of claim 1 wherein the lid further comprises threads and the container comprises threads, wherein the threads of the lid and container cooperate to transition the container between the open and closed configuration and the threads are located above the first seal ring.

5. The open ended container with resealable lid combination of claim 4 wherein at least one of the threads of the lid and container are interrupted threads permitting multiple engagement points of the lid with the container.

6. The open ended container with resealable lid combination of claim 1 wherein the first and second surfaces of at least one of the ramps are oriented at acute angles relative to one another.

7. The open ended container with resealable lid combination of claim 1 wherein the first and second surfaces of at least one of the ramps are oriented at one of perpendicular and obtuse angles relative to one another.

8. The open ended container with resealable lid combination of claim 1 wherein when in the reseal configuration, deformation of the first seal ring along the ramps further comprises contact of the first seal ring with at least one quarter of a length of the first and second surfaces of one of the ramps.

9. The open ended container with resealable lid combination of claim 1 wherein the lid has a channel which at least partially receives at least one of the first and second seal rings therein.

10. The open ended container with resealable lid combination of claim 9 wherein the at least one of the first and second seal rings is one of mechanically and chemically retained in the channel.

11. The open ended container with resealable lid combination of claim 1 wherein two ramps of the seal engagement surface meet at an intersection.

12. The open ended container with resealable lid combination of claim 11 wherein when in the reseal configuration, deformation of the first seal ring along the ramps further comprises contact of the seal ring with the intersection.

13. The open ended container with resealable lid combination of claim 1 wherein the seal engagement surface is located on inside surfaces of the sides of the container.

14. The open ended container with resealable lid combination of claim 13 wherein the first seal ring is located on an inner surface of the lid and is outwardly directed.

15. The open ended container with resealable lid combination of claim 1 wherein the first seal ring is located above a lowest portion of the lid.

16. An open ended container with resealable lid combination comprising:

a container having a bottom with upwardly extending sides extending upwardly until terminating at a rim, outwardly directed threads, and an opening into an internal volume at an upper end of the sides, a lid having a second seal ring circumnavigating the lid, and the lid has internally directed threads, wherein said lid has an open configuration whereby the lid is rotated relative to the container until the threads release thereby permitting access into the internal volume of the container, and a closed configuration whereby the lid is rotated onto the container to prevent access into the internal volume of the container; and after removing the lid from the container, the lid has a reseal configuration whereby the lid is reattached to the container through rotation and the second seal ring resiliently deforms against the rim to provide at least one of an airtight and watertight connection, and wherein said container further has a seal engagement surface comprising at least two ramps, each comprised of first and second surfaces, and the lid further comprises a first seal ring, with said first seal ring deforming against portions of the first and second surfaces of both of the first and second ramps to provide at least one of an airtight and watertight connection and the first seal is located below the second seal in the reseal configuration in communication with the internal volume of the container about an annular surface of the first seal ring.

17. The open ended container with resealable lid combination of claim 16 wherein the second seal ring is located in a channel of the lid.

18. The open ended container of claim 16 wherein the first seal ring is one of mechanically and chemically retained in the channel.

* * * * *